United States Patent [19]

Kongshaug

[11] 4,295,895

[45] Oct. 20, 1981

[54] METHOD FOR STEAM CLEANING OF COMPRESSORS

[75] Inventor: Gunnar Kongshaug, Porsgrunn, Norway

[73] Assignee: Norsk Hydro a.s., Oslo, Norway

[21] Appl. No.: 136,070

[22] Filed: Mar. 28, 1980

[51] Int. Cl.[3] ..... B08B 3/00

[52] U.S. Cl. ..... 134/22 R; 134/23; 134/36; 134/37; 415/1

[58] Field of Search ..... 134/22 R, 23, 30, 36, 134/37; 415/1, 121 A, 168

[56] References Cited

U.S. PATENT DOCUMENTS

| | | | |
|---|---|---|---|
| 2,571,575 | 10/1951 | Holmes | 134/36 X |
| 2,789,927 | 4/1957 | Olson | 134/37 X |
| 3,084,076 | 4/1963 | Loucks et al. | 134/36 X |
| 3,266,934 | 8/1966 | Alexander | 134/36 X |
| 3,297,481 | 1/1967 | Newman | 134/36 X |
| 3,424,371 | 1/1969 | Happe | 415/1 |
| 3,640,810 | 2/1972 | Plasynski et al. | 134/37 X |
| 3,830,660 | 8/1974 | Ezell | 134/23 |

FOREIGN PATENT DOCUMENTS 789930 1/1958 United Kingdom .

*Primary Examiner*—Marc L. Caroff

*Attorney, Agent, or Firm*—Wenderoth, Lind & Ponack

[57] ABSTRACT

A method is provided for the removal of and the prevention of formation of salt deposits in critical sections of a plant. The salt deposits, especially ammonium nitrate deposits, are treated with steam, supplied in such amounts that a water vapor pressure is established which is higher than the existing saturated vapor pressure above the salt deposits at the existing temperatures. The physical requirements for salt removal are hereby immediately established with resulting instantaneous cleaning of all surfaces coated by deposits, independent of where these deposits are located.

8 Claims, 4 Drawing Figures

METHOD FOR STEAM CLEANING OF COMPRESSORS

BACKGROUND AND SUMMARY OF THE INVENTION

This invention relates to the transference and compression of process gas containing impurities as for example in dual pressure plants for production of nitric acid and caprolactam. More specifically, the invention concerns an improved method for removing and preventing the formation of crystalline ammonium nitrate deposits in nitrous gas compressors and in other process streams where such deposition occurs.

The ammonium nitrate deposits which are formed, for instance by unreacted ammonia from catalytic oxidation of $NH_3$ to NO, will in particular reduce the flow capacity of nitrous gas compressors, increase power consumption and may cause imbalance in the rotating parts of the compressors. Furthermore, such salt deposits may represent a safety hazard if the accumulation of salt is not prevented or restricted.

From the days when the first nitrous gas compressors were installed in nitric acid plants over 30 years ago, it has been the practice to utilize injection of and spraying with water to remove the salt deposits. The compressors are usually built with rows of spray nozzles in the flow channels for periodic water injection during plant operation. The time intervals between each washing operation may vary from 4 to 36 hours and the time for the washing operation may vary between 10 and 30 minutes. Normal water addition during washing will be in the region of 0.5–2.0 gram/kmol process gas. Some nitrous gas compressors even have continuous water injection in addition to discontinuous washing.

Water is also normally added continuously to the sealing systems of the compressors to prevent fouling of the labyrinths caused by salt deposits. This water injection which may be up to 500 kg/h, ends up in the product, either by evaporation in the process gas or by drainage as condensate.

Thus, significant amounts of water are used to keep the salt deposits under control. Such addition of wash water to the process gas or to the condensate is, however, undesirable, as the water has to be compensated by a corresponding reduction in the process water to the absorption system, resulting in a reduction in absorption efficiency or in the maximum attainable product concentration.

In spite of prolonged water injection into the compressor, washing does not remove sufficient deposit to restore maximum capacity. This is due to the fact that because of their inertia the injected water droplets do not moisten or humidify all surfaces where deposits occur. In some compressors the salt accumulation on these surfaces may be so extensive that it will be necessary to stop the compressor at intervals for more thorough washing to restore the original capacity.

The injected water droplets may also lead to serious erosion in the compressor, especially on the rotor blades of axial compressors and on the riveted connections in centrifugal compressors.

Furthermore, more efficient removal of the salt deposits is especially desirable to maintain a higher average flow capacity in the compressor, in order to increase the production of the plant.

Thus, it is a main object of the invention to provide a new and improved method for the removal of salt deposits avoiding the above mentioned serious drawbacks.

BRIEF DESCRIPTION OF THE DRAWINGS

The invention now will be described in detail with reference to the accompanying drawings, wherein.

DETAILED DESCRIPTION OF THE INVENTION

Figure 1:
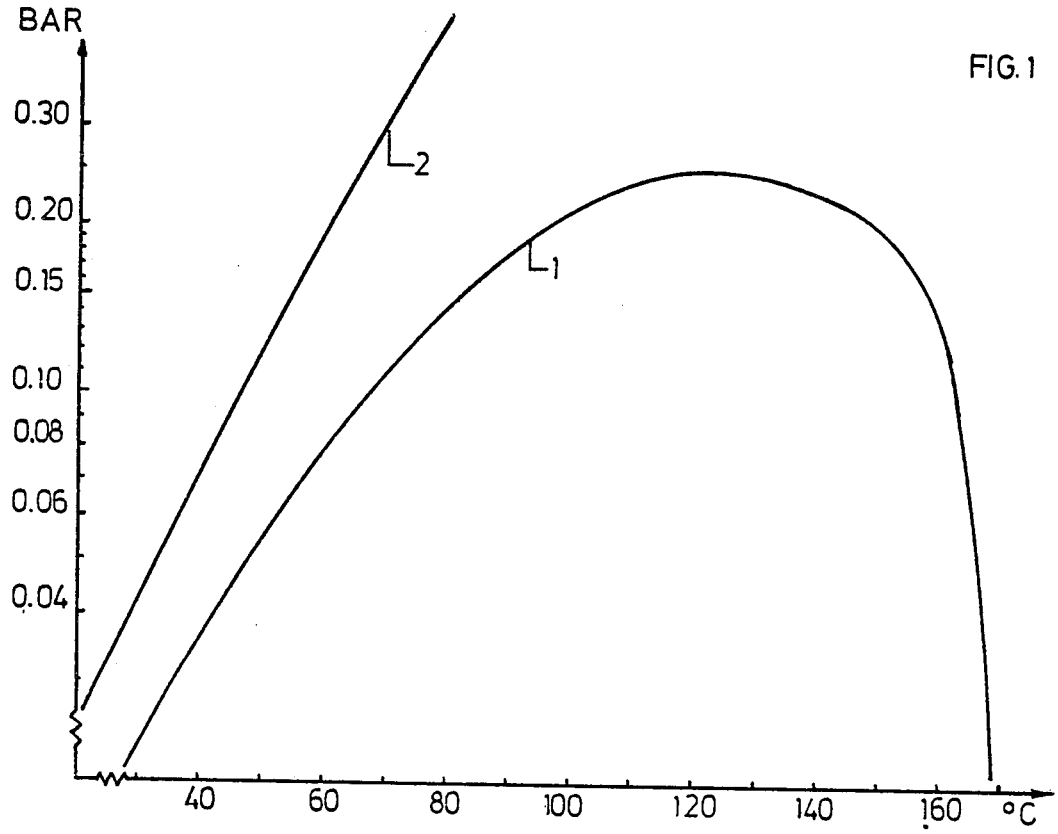
FIGS. 1 and 2 are graphs showing temperature and water vapor pressures in a compressor.

To remove the crystalline salt deposits the physical requirements have to be such that the salt is either transformed into a liquid state, or the salt must be brought up to temperatures where it sublimates or decomposes. By comparing the crystallization point (melting point) for a mixture of ammonium nitrate and water in equilibrium with the water vapour pressure above the mixture, it has been found that there is a temperature dependent upper limit for the vapour pressure where crystalline ammonium nitrate may exist. This relation is graphically illustrated in FIG. 1, where curve 1 shows the water vapour pressure above a saturated solution of the salt and curve 2 shows the saturation or dew point of the process gas. The curves show that crystalline ammonium nitrate cannot exist under any circumstances when the temperature is above 170° C. or when the water vapour pressure is above 0.25 bar.

Figure 2:
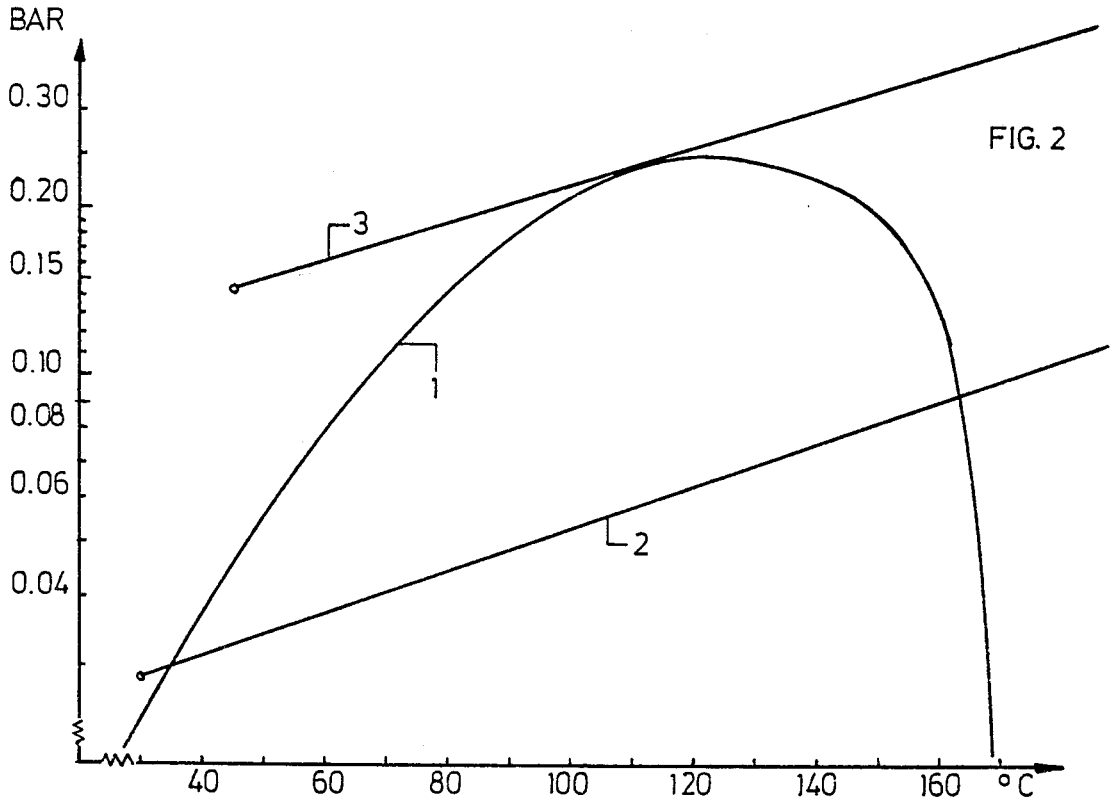

By adiabatic or polytropic compression of the process gas there is a given relationship between pressure and temperature. It is thus possible for a person skilled in the art to calculate the change in water vapour pressure as a function of temperature changes through the flow channel of the compressor. In FIG. 2 the change of water vapour pressure through an arbitrary compressor is shown as a function of temperature. The curves 1 and 2 display that the formation of deposits is possible between 35° C. and 163° C. for a water vapour content corresponding to curve 2.

These fundamental physical data are employed according to the invention to prevent the existence of salt deposits by a suitable increase in the water vapour pressure by utilisation of a special injection of external steam. If the salt deposits are to be removed by increasing the water vapour pressure, i.e. by external steam addition, the water vapour pressure must, at any existing temperature in the compressor, exceed the saturated pressure above the salt deposits at the same temperature. An example of minimum steam addition is illustrated by curve 3 in FIG. 2. For a conventional compressor it is shown that the curve for minimum steam consumption will touch or make a tangent with the saturation curve for salt deposition at about 110° C. and 0.25 bar water vapour pressure.

If one knows the polytropic exponent for the compressor and the moisture content of the process gas before steam injection, the specific steam consumption can be calculated. The steam consumption will normally be approximately 0.067–0.075 kg steam/$m^3$ injected gas (real volume). The percentage reduction in nitrogen oxide load during steam cleaning will thus be strongly dependent upon the suction pressure, and thus vary from approximately 14% when the suction pressure is 0.9 bar, to approximately 2% when the suction pressure is 5 bar.

In the sealing system of a compressor deposits may also be prevented by replacing water with injected pure steam or a mixture of steam and air, which should give a saturated salt solution by all temperatures, even at the highest temperature occuring in the seals or in additional draining pipes.

According to the invention there is thus provided a new method for removing or preventing the formation of salt deposits as explained above. The specific features of this method as well as the specific construction arrangements necessary to practice or perform the method, will be explained below.

The special technical effect which is hereby obtained, is that the physical requirements for salt removal are immediately established with a resulting immediate cleaning effect on all surfaces coated by deposits, substantially independent of where these deposits are situated, or how difficult is access to them.

Practical tests show that the normal requirement for steam is insignificantly higher than the above mentioned minimum steam requirement, and that existing deposits are dissolved already after 15–20 sec. of treatment.

Figure 3:
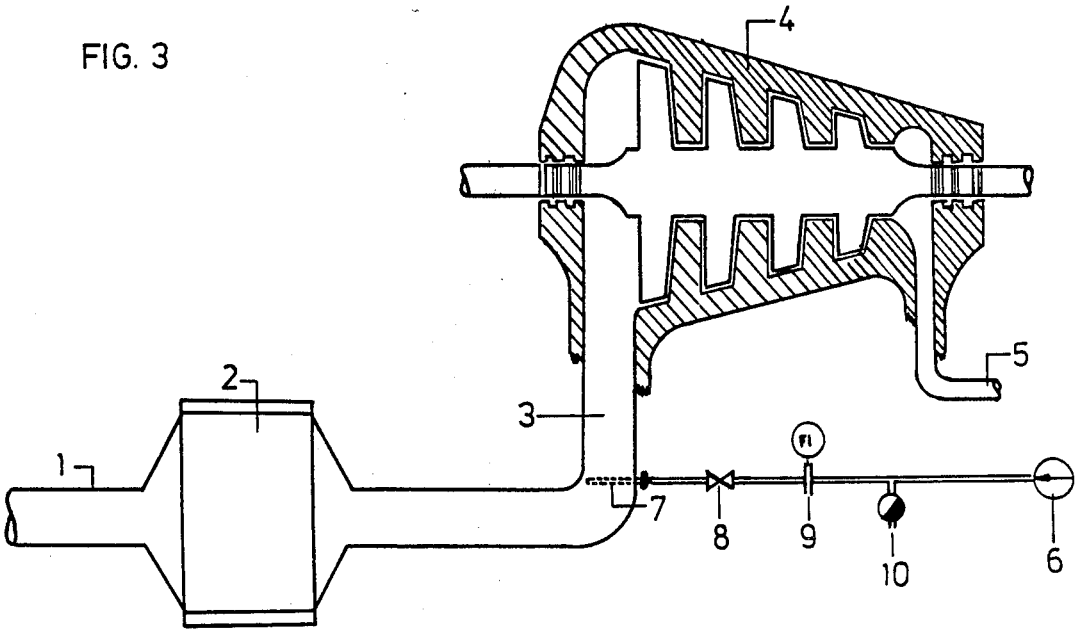
FIGS. 3 and 4 are cross sections through compressors.
Figure 4:
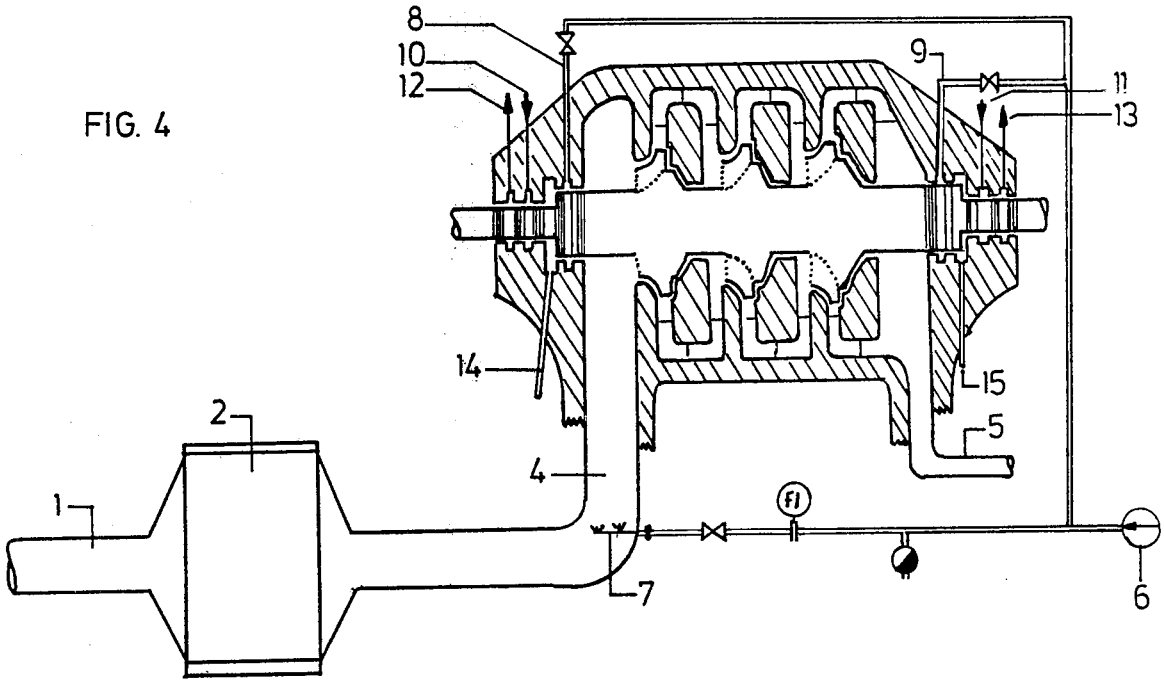

The methods and the means for feeding of steam will be described below with reference to FIGS. 3 and 4 in connection with three different examples of use, i.e., in a low pressure compressor, in a high pressure compressor and in the sealing system of a high pressure compressor.

EXAMPLE 1

Hot nitrogen oxide containing gas 1 (FIG. 3); from an atmospheric combustion plant was cooled to 30° C. in a gas condensator 2. The cooled gas 3, which has a pressure of 0.9 bar abs. was compressed in an axial compressor 4 to 3.0 bar abs. The temperature at the exit 5 of the compressor was 200° C. The hot gas then was cooled and conveyed to an absorption tower, where nitric acid was produced (not shown on the drawings). Compressor capacity when the compressor was clean was 1800 kmol/h, which corresponds to 50,000 $m^3$/h in the inlet 3. During production the load was gradually reduced due to formation of ammonium nitrate deposits. The reduction corresponded to approximately 5% reduction in load per day. The compressor had no continuous water injection, but every 8th hour the compressor was treated with steam from a steam reservoir 6. During this treatment the load would be reduced by approximately 30 kmol/h. The steam saturated at 5 bar abs. was injected into the suction side of the compressor through a perforated tube 7, which was placed at right angles in relation to the gas stream, approximately 1½ m in front of the compressors. The perforated tube had a diameter of 100 mm and contained approximately 80 perforations, each with a diameter of 15 mm. The addition of steam was regulated through a valve 8 and the amount registered through a measuring device 9. Any condensate which occurred was drained into a condensate pot 10. During the steam washing 3500 kg steam/h was introduced for approximately 15 sec. The total amount of steam during the washing period was thus 15–25 kg, depending upon how fast the nitrogen oxide load could be altered without disturbing the combustion unit. During the steam addition the temperature in the inlet 3 of the compressor increased to 45° C. and the temperature in the outlet 5 of the compressor decreased to 195° C. The temperature and pressure changes in the other parts of the nitric acid plant were negligible during the steam injection. During the steam addition the flow of nitrogen oxide containing gas from the combustion plant 1 decreased by approximately 14%. After steam injection the compressor was again clean and performed at maximum capacity.

EXAMPLE 2

Hot nitrogen oxide containing gas 1 (FIG. 4) was cooled in a condenser 2 to 30° C. and thereafter compressed in a radial compressor. The pressure at the suction side 4 of the compressor was 4.5 bar abs., and at the outlet 5 of the compressor the pressure was 10 bar abs. and the temperature 100° C. The capacity of the compressor was 1800 kmol/h, which corresponds to 10,000 $m^3$/h at the inlet 4 of the compressor.

The compressor was cleaned with 700 kg steam/h for approximately ½ minute each 8th hour (the total amount of steam was 6–10 kg). The steam which was saturated at 10 bar abs. was led from a steam source 6 via a pipe line and added to the process gas through two nozzles which were placed approximately 1½ m in front of the compressor and arranged to mix uniformly with the gas stream. Changes in temperature and pressure during and after the addition of steam were negligible and did not disturb the production.

During the addition of steam the flow of nitrogen oxide containing gas 1 decreased by approximately 2%. After the addition of steam the compressor again performed at maximum capacity.

EXAMPLE 3

Steam from the same source 6, but by means of special pipes and nozzles, was continuosly injected into the labyrinth gland seals 8 and 9 of the compressor. An air-lock 10, 11 was added to both packing-boxes of the compressor, which were also provided with ventilating means 12,13 and means for draining off steam and condensate 14,15. Approx. 1 kg steam/h was lead through the labyrinth-seals 8 and approx. 2.5 kg steam/h was led through labyrinth-seals 9. Thus conventional water injection of approximately 200 kg/h was replaced and an efficient prevention of salt formation was obtained.

With basis in the results from the above examples, and of additional tests which have been performed, it can be concluded that steam can be added in amounts of from 0.02–3 kg per $m^3$ process gas, but should preferably be added in amounts of from 0.067–0.075 kg per $m^3$ process gas.

Furthermore, in the compressors and other parts of the plant, there is no need to inject steam over a longer period of time than 15 minutes. During plant operation, however, it is preferable to add steam at intervals of less than 1 minute. There are no reasons for working out an optimal time interval between steam injection operations, since the conclusion is that the flexibility here is very great.

By the replacement of conventional water washing with the salt removal method according to the invention, the cleaning operation has become far more efficient. The addition to the process of unwanted water, may be reduced by up to 90%, and the necessary washing time will be strongly reduced. Furthermore, the period between each washing may be reduced giving an increase of the average load of the system. Injected steam will also eliminate the erosion problems caused by water injection into the compressors.

The construction of the compressors may also be simplified by using steam for cleaning instead of water washing. The provision of steam nozzles, in the form of perforated tubes or the like upstream of the compressor, will replace the conventional rows of small spray nozzles, which now have to be locaed in the flow channels of the compressor. This necessitates the drilling of holes through the casing of the compressor and which also results in complicated and more expensive constructional configurations.

Thus, there are obtained significant advantages in the cleaning method according to the invention. Even if it may not be surprising that the salt deposits are removed when the water vapour pressure is increased above the equilibrium pressure for saturated solutions of the salt, it is indeed surprising that the salt will be dissolved in such a short time. While addition of water to the compressors normally had to be continued for up to 30 minutes, without even returning to original flow capacity, one obtains complete cleaning with steam injection after only 15–30 sec. Even if the immediate steam consumption in low pressure compressors is relatively high, this short time of cleaning will drastically reduce the total water addition to the process. The short washing time will only result in a slight loss of production during cleaning. In high pressure compressors the immediate need for steam is significantly lower, such that even the momentary water addition will be less than during water washing.

A prejudice concerning the removal of salt deposits by steam injection has probably been the fear that the higher temperature in the inlet would lead to an inpermissible temperature rise in the outlet of the compressor. Water vapour has, however, greater specific heat capacity than the process gas and tests have shown that a certain steam addition in fact results in a lowering of the outlet temperature during cleaning.

Even though the invention is described primarily in connection with the prevention of and removal of salt deposits in nitrous gas compressors and supplementary sealing systems where the precipitation problems are greatest, it is evident that the method according to the invention also may be utilized in other process sections where such problems occur. In fact the technique is generally suitable also for other systems where deposits of salts are formed and where it is possible by the regulation of temperatures and vapour pressure to establish the necessary conditions for immediate dissolution of salt deposits.

I claim:

1. In a method for removing and preventing the formation of salt deposits in critical sections of a plant where process gases containing impurities including ammonium nitrate are transferred and compressed, the improvement which comprises supplying steam to said sections in such amounts that a water vapour pressure is established in excess of the saturated water vapour pressure above the salt deposits at the existing temperatures.

2. A method according to claim 1, characterized in that steam is injected at intervals into nitrous gas compressors upstream of or at their inlets.

3. A method according to claim 1, characterized in that steam is injected into said compressors in an amount of from 0.02–3 kg per $m^3$ process gas.

4. A method according to claim 3, wherein said steam is injected in an amount of from 0.067–0.075 kg per $m^3$ process gas.

5. A method according to claims 1, 2 or 3, characterized in that steam is injected over short periods of time of less than 15 minutes.

6. A method according to claim 5, wherein said periods of time are less than one minute.

7. A method according to claim 1, characterized in that steam is injected into sealing systems of compressors.

8. A method according to claim 7, characterized in that steam is injected with accompanying air, and that the amount of steam and air is regulated to obtain a water vapour pressure which always corresponds at least to the saturation water vapor pressure of the salt deposits at the highest temperatures which exist in the sealing system.

* * * * *